US006756902B2

(12) United States Patent
Li

(10) Patent No.: US 6,756,902 B2
(45) Date of Patent: Jun. 29, 2004

(54) DOZE ALERTING DEVICE

(75) Inventor: Yat Wah Li, Kowloon (HK)

(73) Assignee: Billion Team Limited, Kowloon (HK)

( * ) Notice: Subject to any disclaimer, the term of this patent is extended or adjusted under 35 U.S.C. 154(b) by 89 days.

(21) Appl. No.: 10/012,479

(22) Filed: Dec. 12, 2001

(65) Prior Publication Data

US 2003/0107489 A1 Jun. 12, 2003

(51) Int. Cl.[7] ..... G08B 23/00

(52) U.S. Cl. ..... 340/575; 340/576; 340/573.7; 200/541; 200/547; 200/550

(58) Field of Search ..... 340/575, 576, 340/384.7, 390.1, 573.7; 200/541, 547, 563, 564, 550

(56) References Cited

U.S. PATENT DOCUMENTS 4,555,697 A * 11/1985 Thackrey ..... 340/575
5,841,354 A * 11/1998 Bae et al. ..... 340/575
6,154,141 A * 11/2000 Prater et al. ..... 340/575

* cited by examiner

*Primary Examiner*—Daniel J. Wu
*Assistant Examiner*—Son Tang
(74) *Attorney, Agent, or Firm*—Leydig, Voit & Mayer, Ltd.

(57) ABSTRACT

A doze alerting device includes a casing, an earplug and an electronic operating circuit. The earplug is insertable into either the left or right ear of a user to locate the casing at a desired angular position. The circuit incorporates an audio generator for generating a doze-alert audio signal and a gravity switch for triggering the generator. The switch has first and second contacts closing to trigger the generator, with the second contact being movable under the influence of gravity along a path towards and away from the first contact. The path is fixed relative to the casing so that the switch provides a trigger signal when the casing moves from a first angular position corresponding to an upright position of the head when the user is looking straight ahead to a second angular position corresponding to a dipped position of the head when the user starts to doze. The path is linear so that the device can be used at either the left or the right ear of the user without any material effect on the angular positioning of the casing and the operation of the switch.

9 Claims, 2 Drawing Sheets

DOZE ALERTING DEVICE

The present invention relates to a device for use at the ear of a user for alerting the user against dozing.

BACKGROUND OF THE INVENTION

Dozing can be dangerous in certain situations, such as when a person is driving a car. Doze alerting devices of the type concerned for use at the ears should have been known in general, but the very few ones known are found to have shortcomings. For example in one such device, a mercury switch is used as a gravity sensor to detect the lowering of a user's head when the user starts to doze, but mercury switches tend to be bulky and are not safe by nature. In general, all such devices are inconvenient to use because they are designed for use at one particular left or right ear of the users and their sensitivity can hardly be adjusted.

The invention seeks to mitigate or at least alleviate such shortcomings by providing an improved doze alerting device.

SUMMARY OF THE INVENTION

According to the invention, there is provided a doze alerting device comprising a casing, an earplug connected with the casing, said earplug being insertable selectively into either one of the left and right ears, as desired, of a user to locate the casing on the head of said user at a desired angular position relative thereto, and an internal electronic operating circuit. The operating circuit incorporates an audio generator for generating a doze-alert audio signal for said user and a gravity switch for triggering the audio generator. The gravity switch has first and second solid electrical contacts for switching on or off to trigger the audio generator, with the second contact being movable under the action of gravity along a defined path towards and away from the first contact to perform switching. The path is fixed relative to the casing for simultaneous angular movement therewith such that the gravity switch will provide a trigger signal when the casing moves from a first angular position corresponding to an upright position of said head when said user is looking straight ahead to a second angular position corresponding to a dipped position of said head when said user starts to doze, with the path tilting to below the horizontal. The path is substantially linear such that the doze alerting device can be used at either the left or the right ear of said user without any material effect on the angular positioning of the casing and the operation of the gravity switch.

Preferably, the earplug is fixedly connected to the casing and has a substantially circular shape such that it can be turned within said ear to adjust the angular position of the casing relative to said head.

Preferably, the casing is elongate and has a front end and a rear end, to which rear end the earplug is connected.

In a preferred embodiment, the casing has a longitudinally extending axis, and the path extends substantially parallel to the axis.

More preferably, the casing has a substantially symmetrical shape on opposite sides about its axis.

It is further preferred that the casing has a plane of substantial symmetry along its axis, and the path lies in that plane.

It is further preferred that the earplug has a substantially circular shape about a central axis, which axis intersects with that of the casing such that the casing and the earplug share a common plane of substantial symmetry.

It is preferred that the audio generator is implemented based on an IC chip and includes a buzzer.

In a preferred embodiment, the gravity switch has a elongate body encasing the second contact and defining the path for the second contact.

More preferably, the body comprises a tube having a circular cross-section and the second contact is in the form of a ball.

More preferably, the first contact and a third solid electrical contact of the gravity switch are fixed at opposite ends of the body to provide two terminals. The body includes an inner surface which is electrically conductive and in electrical connection with the third contact and with which the second contact is in continuous sliding electrical contact.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figures 1A, 1B, 1C, 1D:
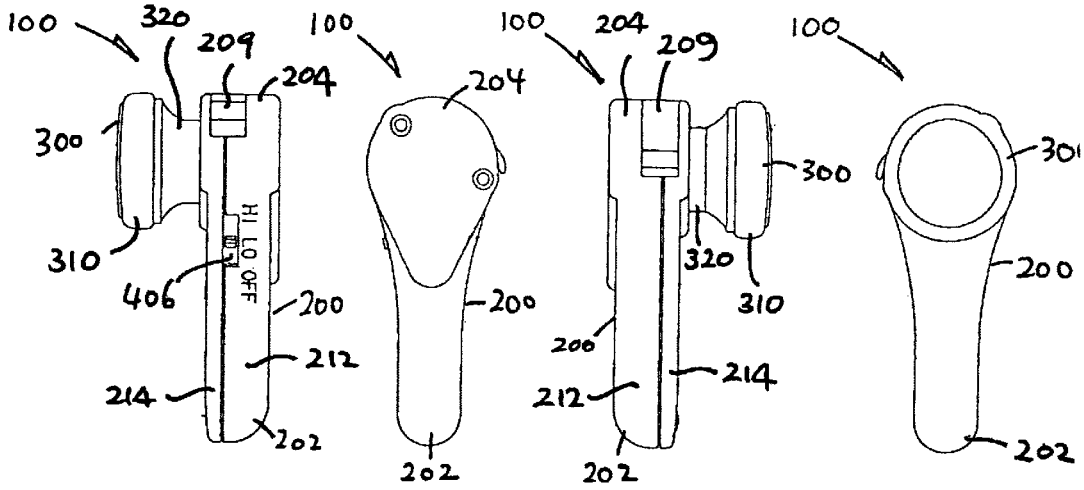
FIGS. 1A to 1D are four side views of an embodiment of a doze alerting device in accordance with the invention.

Referring to the drawings, there is shown a doze alerting device 100 embodying the invention, which device 100 comprises an elongate plastic casing 200 having a longitudinally extending central axis of symmetry and a circular plastic earplug 300 fixedly connected therewith. The casing 200 includes outer and inner shells 212 and 214 closing each other, which together have a relatively smaller rounded front end 202 and a relatively larger rounded rear end 204. The earplug 300 is connected at right angles to the inner shell 214, at the rear end 204 thereof, by two screws 206 that also secure the two shells 212 and 214 together.

The earplug 300 is in the form of a circular knob 310 having a co-axial integral stem 320 that is connected to the casing 200 by the screws 206. The axis of the earplug 300 intersects with that of the casing 200 such that the casing 200 and the earplug 300 share a common plane of symmetry. The knob 310 is insertable selectively into either one of the left and right ears of a user to locate the casing 200 on the head of the user. As the knob 310 has a circular shape that is symmetrical, it can fit within either the left or the right ear as desired at reversed positions. As the knob 310 is circular, it can also be turned through a limited angle of about 90° within the ear to adjust the angular position of the casing 200 relative to the head. Because the casing 200 is likewise symmetrical in terms of shape, it can fit either the left or the right ear at opposite reversed positions, as appropriate.

The doze alerting device 100 includes an electronic operating circuit 400 mounted on a printed circuit board 410 that is located within the casing 200. The operating circuit 400 is implemented based an IC chip 402 whose primary function is to act as an audio generator for, upon trigger, generating an audio signal, such as a sound or a series of tunes, to alert the user upon dozing. The audio signal is to be output by means of a disc-like buzzer 404 that forms part of the audio generator. The buzzer 404 is located within the knob 310 of the earplug 300.

The casing 200 provides a battery compartment 207 at its rear end 204 to house a button battery cell 208 for powering the operating circuit 400. The compartment 207 is closed by a hinged lid 209 that also serves to locate the battery cell 208 in the compartment 207.

Figure 3:
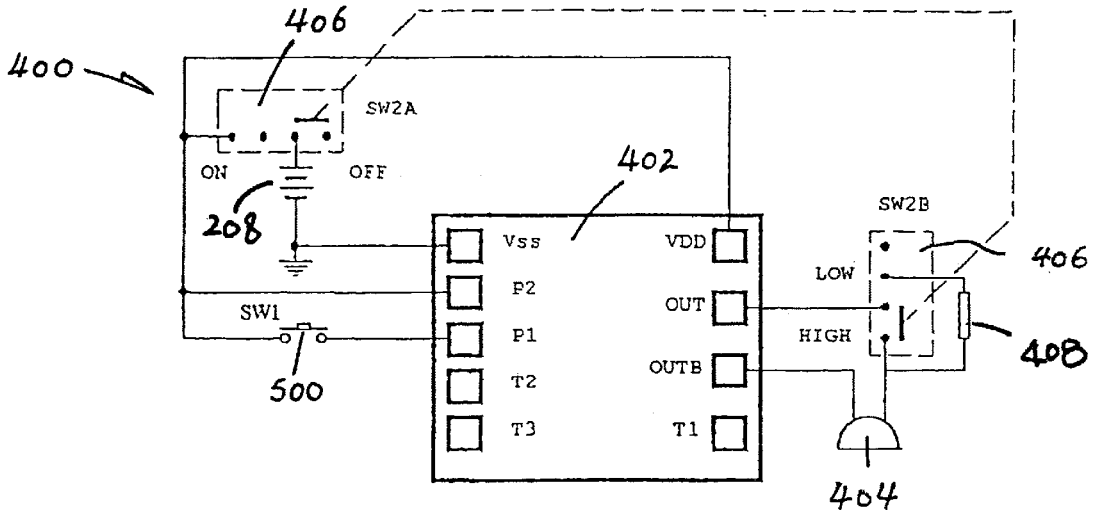
FIG. 3 is a circuit diagram of the electronic operating circuit of FIG. 2.
Figure 4:
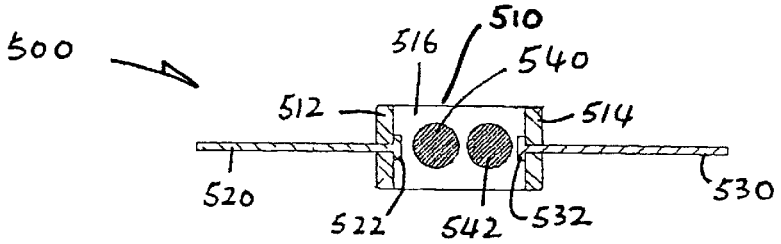
FIG. 4 is a cross-sectional side view of the gravity switch of FIG. 2.
Figure 2:
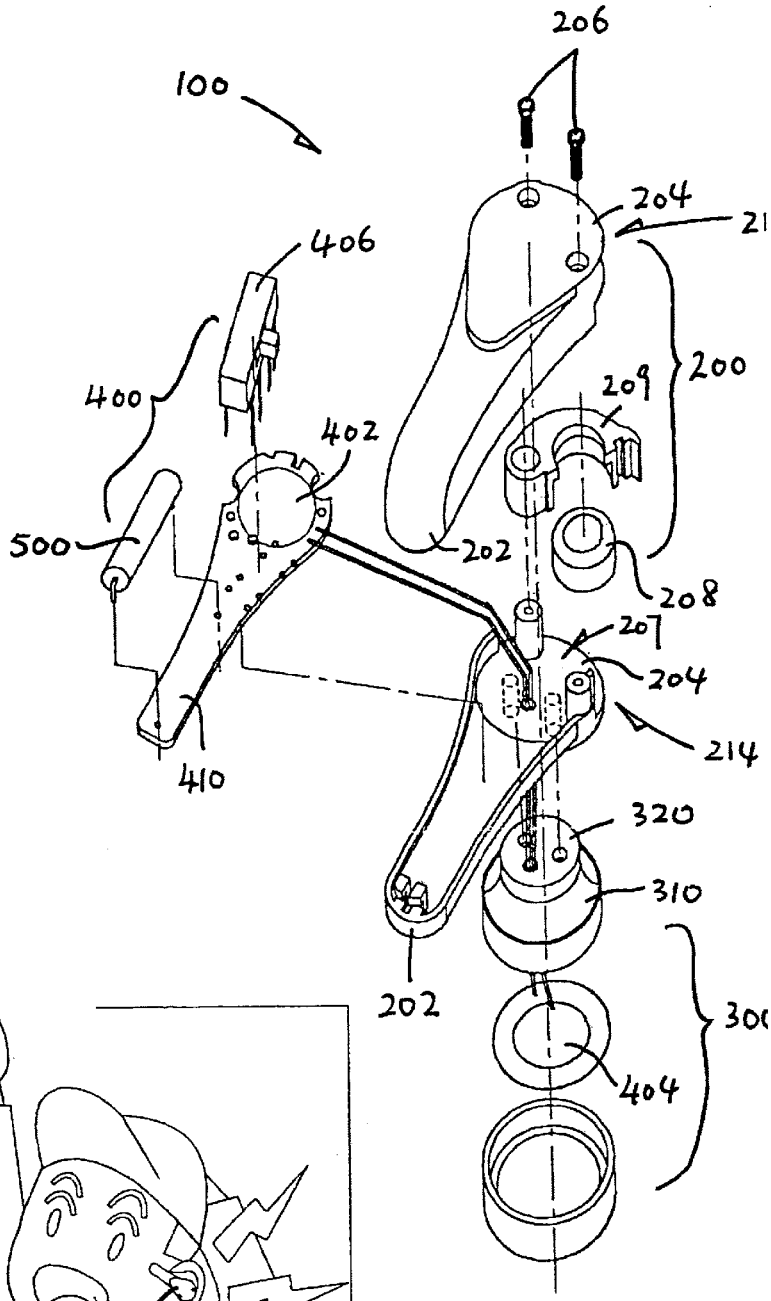
FIG. 2 is an exploded perspective view of the doze alerting device of FIGS. 1A–1D, the device incorporating an electronic operating circuit that includes a gravity switch.

The operating circuit 400 includes a double-pole slide switch 406 that is mounted on the circuit board 410 and is accessible on one side of the casing 200. The switch 406 acts as a master switch to switch on and off the overall operating circuit 400 and, whilst the circuit 400 has two on states, to select the volume of the buzzer 404 between high and low. As shown in FIG. 3, a resistor 408 is to be connected by the switch 406 in series with the buzzer 404 to reduce its volume.

The operating circuit 400 further includes a gravity switch 500 for triggering the IC chip 402 to provide an alert signal, which is also mounted on the circuit board 410 and is concealed wholly within the casing 200. The gravity switch 500 has a straight body tube 510 that is located to extend parallel to the casing 200 or its central axis. The tube 510 has a circular cross-section, opposite end walls 512 and 514 and an electrically conductive cylindrical inner surface 516. The first end wall 512 is electrically insulating, whereas the second end wall 514 is electrically conductive and in electrical connection with the inner surface 516.

A pair of terminals 520 and 530 is provided at the two end walls 512 and 514 of the body tube 510 respectively. Each terminal 520/530 has an inner end that extends through the corresponding end wall 512/514 into the tube 510 and acts as a respective fixed solid contact 522/532 located on and in direct contact with the inner surface of the end wall 512/514.

The body tube 510 encases two electrically conductive solid metal balls 540 and 542. Each ball 540/542 has a diameter marginally smaller than the inner diameter of the tube 510 such that either ball 540/542 can roll and/or slide freely, under the action of gravity, along a linear path as defined by the tube 510. Both balls 540 and 542 are in continuous sliding electrical contact with the inner surface 516 of the tube 510 and in turn electrical connection to the second contact 532. The first ball 540 will move to come into contact with the first contact 522 immediately upon the tube 510 dipping downwards at its first end 512. When this occurs, the first and second contacts 522 and 532 are electrically connected together, whereby the gravity switch 500 is changed from a switched-off condition to a switched-on condition. The second ball 542 does not play a key role in terms of switching, but it improves the responsibility and conductivity of the overall switch 500.

The gravity switch 500 is located within the casing 200 such that the first end 512 of its body tube 510 points in the same direction as the front end 202 of the casing 200. Accordingly, the first end 512 of the gravity switch 500 will inherently and simultaneously be inclined or tilted upwards or downwards as the front end 202 of the casing 200. Under this arrangement, the gravity switch 500 will be opened and remains open when the casing 200 is inclined with its front end 202 upwards and will be closed as soon as the casing 200 is inclined with its front end 202 downwards.

In use, the doze alerting device 100 is initially mounted at either the left or the right ear, as desired, of the user such that its casing 200 is tilted with its front end 202 upwards, corresponding to the situation when the user is looking straight ahead with his/her head in the normal, upright position. When the user starts to doze, he/she will dip his/her head. As soon as he/she does that to the extent titling the front end 202 of the casing 200 downwards crossing or to below the horizontal, i.e. changing from inclination to declination, the gravity switch 500 will be closed as described above, thereby provide a trigger signal for the IC chip 402 to produce an audio signal to warn the user against dozing.

The initial angular position of the casing 200 determines the sensitivity of the doze alerting device 100. If the casing 200 is inclined upwards at a relatively larger angle, the lower the head of the user must dip in order to turn and close the gravity switch 500. On the other hand, the doze alerting device 100 will become more sensitive if the casing 200 is inclined upwards at a relatively smaller angle from the horizontal. Apart from the personal choice of a particular user driving a specific car for example, adjustment of the sensitivity is also dependent upon the location of the various meters of that car below the eye level of that driver.

As the body tube 510 is straight and defines a linear path for the ball 540 to move, there is no material effect on the angular positioning of the casing 200 and the operation of the gravity switch 500. This, coupled with the symmetrical shape of the casing 200 and earplug 300 on opposite sides about their respective central axes on a common plane of symmetry, makes the doze alerting device 100 perfectly equally suitable for use at either the left or the right ear of a user. In general, the operation of the doze alerting device 100 is indistinguishable whether it is used at the left ear or the right ear of a user.

Figure 5:
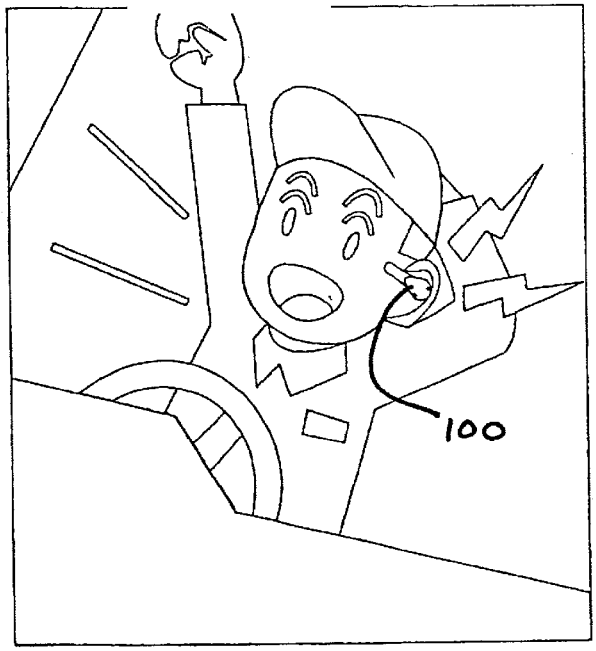
FIG. 5 is a schematic diagram illustrating the use of the doze alerting device of FIG. 1 by a driver.

The doze alerting device 100 is intended for use in a situation where the user should be fully awake such as when he/she is driving a car (see FIG. 5) or operating a machine, or the user wants to keep attentive such as when he/she is studying or attending a lecture or meeting.

It is envisaged that the casing 200 may be made pivotable relative to the earplug 300, in which case the earplug 300 may be designed to have a specific non-circular shape that would fit in the ear more firmly, and yet adjustment of the angular position of the casing 200 remains possible.

The invention has been given by way of example only, and various other modifications of and/or alterations to the described embodiment may be made by persons skilled in the art without departing from the scope of the invention as specified in the appended claims.

What is claimed is:

1. A doze alerting device comprising:

a casing, an earplug connected to the casing, the earplug being insertable into either the left or right ear of a user, and an internal electronic operating circuit incorporating an audio generator for generating a doze-alert audio signal and a gravity switch for triggering the audio generator, the gravity switch having first and second electrical contacts for closing to trigger the audio generator, an elongate body encasing and defining a path for the second contact, and a third electrical contact, the first and third contacts being fixed at opposite ends of the elongate body as respective terminals, wherein the elongate body includes an electrically conductive inner surface electrically connected to the third contact, the second contact is in continuous sliding electrical contact with the electrically conductive inner surface and is movable by gravitational force along the path towards and away from the first contact for switching, the path being fixed relative to the casing, for simultaneous angular movement with the casing, so that the gravity switch will close to provide a trigger signal when the casing moves from a first angular position to a second angular position, and the path is substantially linear such that the doze alerting device can be used at either the left or the right ear of the user.

2. The doze alerting device as claimed in claim 1, wherein the earplug is fixedly connected to the casing and has a substantially circular shape for adjusting angular position of the casing relative to a user's head.

3. The doze alerting device as claimed in claim 1, wherein the casing is elongate and has a front end and a rear end and the earplug is connected to the rear end.

4. The doze alerting device as claimed in claim 3, wherein the casing has a longitudinally extending axis, and the path extends substantially parallel to the axis.

5. The doze alerting device as claimed in claim 4, wherein the casing has a substantially symmetrical shape on opposite sides of an extending axis.

6. The doze alerting device as claimed in claim 5, wherein the casing has a plane of symmetry along the extending axis, and the path lies in the plane.

7. The doze alerting device as claimed in claim 5, wherein the earplug has a substantially circular shape with a central axis intersecting the extending axis so that the casing and the earplug have a common plane of symmetry.

8. The doze alerting device as claimed in claim 1, wherein the audio generator includes an IC chip and a buzzer.

9. The doze alerting device as claimed in claim 1, wherein the body comprises a tube having a circular cross-section and the second contact is spherical.

* * * * *